US008752324B2

(12) United States Patent
Muller

(10) Patent No.: US 8,752,324 B2
(45) Date of Patent: Jun. 17, 2014

(54) ALUMINUM CHOKE TUBE FOR A SHOTGUN

(76) Inventor: James Richard Muller, Southbury, CT (US)

( * ) Notice: Subject to any disclaimer, the term of this patent is extended or adjusted under 35 U.S.C. 154(b) by 435 days.

(21) Appl. No.: 12/592,565

(22) Filed: Nov. 25, 2009

(65) Prior Publication Data

US 2011/0119983 A1 May 26, 2011

(51) Int. Cl.
*F41A 21/40* (2006.01)

(52) U.S. Cl.
USPC ..... 42/79

(58) Field of Classification Search
USPC ..... 42/79
See application file for complete search history.

(56) References Cited

U.S. PATENT DOCUMENTS 2,668,479 A * 2/1954 Batten ..... 89/14.3
2,990,342 A * 6/1961 Sullivan ..... 205/131
6,052,935 A * 4/2000 Howard ..... 42/79
7,140,140 B2 * 11/2006 Yoshitaka ..... 42/79
2004/0111947 A1 * 6/2004 McComas ..... 42/76.02
2005/0011102 A1 * 1/2005 Boyer ..... 42/79
2006/0010750 A1 * 1/2006 Yoshitaka ..... 42/79

* cited by examiner

*Primary Examiner* — Daniel J Troy

(57) ABSTRACT

This invention is in relation to a shotgun choke tube made of aluminum in which sometimes this aluminum choke tube may be coated with an anodize, hard coating or plating of some sort to increase hardness, strength, lubricity, corrosion resistance, etc to the aluminum. The aluminum choke tube is composed of a cylindrical tube having a sealing face against the bore of the shotgun bore, multiple clearance diameters, an outside body diameter, threads and on the extended version choke tubes, there is a portion of diameter that extends outward beyond the end of the muzzle of the shotgun barrel. The inside diameters are comprised of tapers, sometimes straights and multiple geometries to act as somewhat of a funnel. The aluminum choke tube is held in place securely inside the shotguns barrel by means of usually a thread or other geometrical design created by the shotgun manufacturer.

11 Claims, 3 Drawing Sheets

ALUMINUM CHOKE TUBE FOR A SHOTGUN

BACKGROUND OF THE INVENTION

1. Field of the Invention

This Invention relates to a choke tube that attaches to the muzzle end of a shotgun.

2. Description of the Related Art

A threaded choke tube, interchangeable choke tube or screw in choke for a shotgun is a cylindrical tube made of steel, stainless steel or titanium that threads into the muzzle end of a shotgun to produce specific ballistic choking or compression of the pellets, BB's or shot in the shotgun shell as it is traveling down the barrel and comes into the choke constricted area at the muzzle where the choke tube is present. The shot string gets squeezed down less or more depending on the amount of choke or constriction inside that specific choke tube. The important need for a choke is to be able to have or gain advantages at different distances, because, the way a shotgun works pertaining to shot string and choke is this, if the shot pattern needs to be small in diameter or tight, we use "FULL" choke, this makes the shot string capable of hitting its target at the farthest possible ballistic capabilities of that shot size, then on the opposite end of the spectrum we have "CYLINDER" choke or bore which is no choke constriction at all, this allows the pattern or shot string to open as large as possible to give a large diameter shot string for the closest of targets giving a larger margin of error in aiming and still hitting the target, for example, a "FULL" choke pattern at 20 yards distance could be approximately 12 inches in diameter, while the same type of choke tube in "CYLINDER" choke may be more like 30 inches in diameter at the same 20 yard distance hence allowing more margin of error on the shooters part and still hitting their target.

Choke tubes give the option of having the availability of many different choke offerings in the same gun, with just a few turns you can change from one choke constriction to another by removing or unscrewing one choke tube and installing another choke of your choice depending on your target presentation or distance rather than having to settle with one choice of a fixed choke barreled shotgun.

The difference in fixed choke barrels and screw in choke tubes is mainly this, because the fixed choke barrels have a long straight choke portion they are usually superior to screw in choke tubes because they give the shot string a longer time to transition from the tapered entry down into the tighter straight choke portion before leaving the muzzle, this in turn leads to less deformed shot BB's and more consistent, uniform shot patterns. When shot is deformed from being crammed into a short choke the result is more "flyers" this is when deformed BB's refuse to stay together with the rest of the shot string because they are no longer round or uniform, so when they hit the air immediately upon leaving the muzzle the BB's that are deformed fly outward called flyers and are lost to the effective shot pattern when they reach the target.

The way to resolve this problem of short screw in choke tubes is to make extended screw in choke tubes. The extended screw in choke tube is a type of choke tube that extends out of the front of the muzzle and gives the barrel a longer appearance. This solves one problem and that is, it gives a longer straight choke portion and is closer to a fixed choke barrel. This is far more advantageous to a flush mount or short choke tube because of what we explained above about shot deformation. However, due to the extra length and added metal to obtain this length there is a considerable amount of weight added out on the muzzle end of the shotgun, which is very noticeable to the extent in which where the factory balance point of the shotgun was originally made is totally thrown off. The shotgun thus no longer points or responds the way it was developed or designed to, and leaves users unhappy with the feel of their shotguns balance.

SUMMARY OF THE INVENTION

This present invention has been developed and made in a way to correct this weight distribution problem by means of changing the material to Aluminum. The Specific Gravity of Aluminum is only 2.64, whereas the Specific Gravity of Steel is 7.93 which makes Aluminum only ⅓ the weight of a steel or stainless steel choke tube which in turn allows for a choke tube to be made 3 times longer and still weigh the same as a steel or stainless steel one, thereby solving not only one problem but two problems, we now have a choke tube that can be made to weigh the same as a factory flush mount choke tube and give back to the user the original balance and pointability of their shotgun while also giving them the superior pattern benefit of a long fixed choke barreled shotgun.

In this present Invention, an assortment of coatings, films, anodizing, hard coat anodizing, ceramic anodizing, etc. can give the user specific options of hardness, environmental durability, longevity, color and lubricity that a steel or stainless steel choke tube could not offer.

In this present Invention, a series of grooves, undercuts and notches may be cut or formed in a longitudinal and/or circumferential pattern that enables the user to grip the choke tube comfortably by hand to tighten or loosen the choke tube for easy removal and insertion, even in wet, cold, hot or adverse conditions.

In the present Invention, certain coatings, anodizing, plating or films can be applied to increase wear resistance, hardness, structural strength and integrity as well as corrosion resistant properties, thread protection, increased tensile strength and rigidity.

In this present Invention, laser etching, laser engraving or engraving will ultimately be very user friendly to allow immediate identification as to what choke or constriction a particular choke tube is thanks to easy to read characters and contrasting appearance.

In this present Invention, the identification marking produced by laser etching, laser engraving or engraving will be readable or identifiable while it is inserted or installed into the muzzle of the shotgun as well as when it is out of the shotgun on its own.

In this present Invention, the identification described above will directly coincide with the perceived shot string constriction or as it is described, choke. In this current Invention, the identification may be marked as "C" or "CYL" or "CYLINDER" or "0.000" all identifying cylinder choke as well as the similar for Skeet, Skeet 1, Skeet 2, Improved Cylinder, Light modified, Modified, Improved Modified, Light Full, Full, Extra Full, etc., but not limited to just these constrictions or chokes.

In this present Invention, a series of one or more grooves or slots or notches to accommodate a tool or choke tube wrench in which to aid the tightening or loosening of a choke tube while in the muzzle of a shotgun barrel could be applied.

In this present invention, the edges, corners, grooves and all other geometric lines could have Radii or chamfers to improve smoothness, aesthetics, longevity and durability.

DETAILED DESCRIPTION OF THE INVENTION

I will now describe the present Invention in detail based on the embodiments displayed in the figures.

Figure 1:
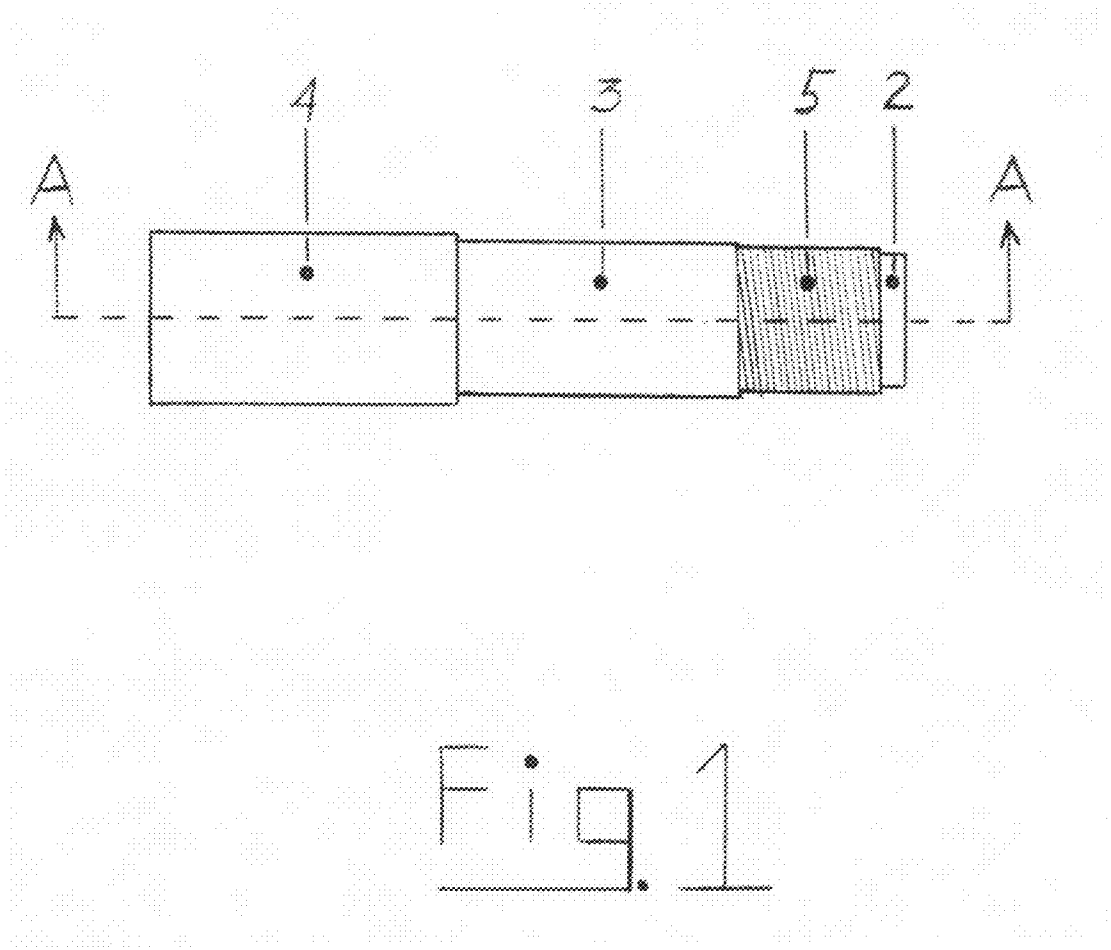
FIG. 1. Is a Front view showing an example of the Aluminum choke tube according to the present Invention.
Figure 2:
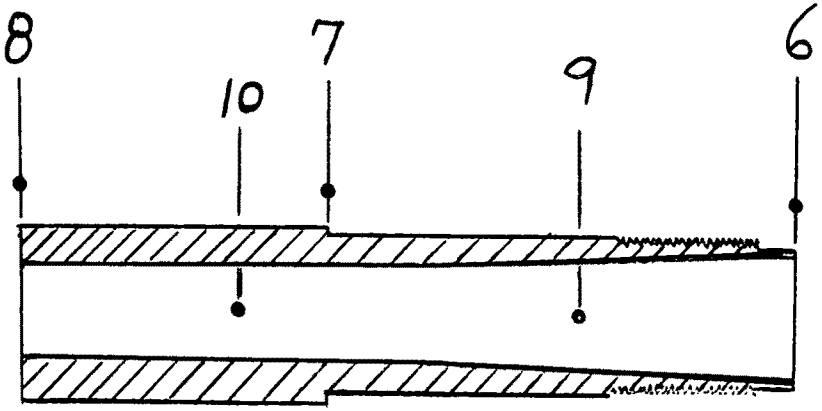
FIG. 2. Is a section view A-A of the same Aluminum choke tube example.
Figure 3:
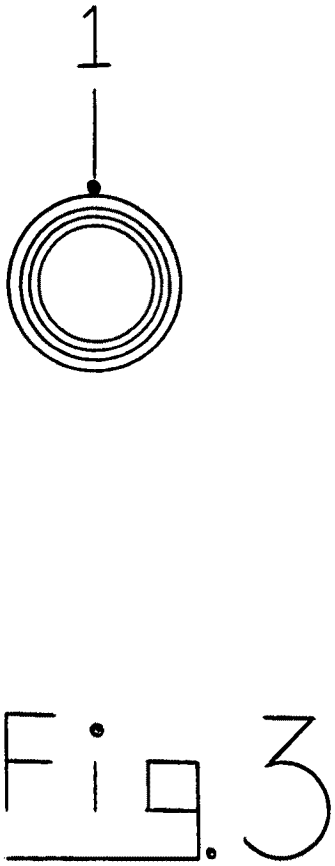
FIG. 3. Is a Right Side view of the same Aluminum choke tube example.

FIGS. 1-3 show an Aluminum choke tube 1. The choke tube 1 is made up of an Aluminum cylindrical tube having multiple outside diameters. The choke tube 1 includes a body clearance 2, a body 3, and an extended head 4, respectively. The choke tube 1 also includes threads 5 where it attaches to the inside of the mating muzzle thread of the shotgun barrel. The choke tube 1 further includes multiple faces including a gas seal 6, a head shoulder 7, and a muzzle face 8. The inside diameters noted as taper from shotgun bore diameter 9 and straight choke portion 10 show the choke geometry resulting in the choking effect based on a ballistic pattern of how many BB's fit inside a 30 inch circle at specific yardages which determines choke name or amount.

The Present Invention is machined and manufactured from solid aluminum bar or aluminum tubing or aluminum flat stock regardless of grade of aluminum. The use of this Aluminum material ensures there will be no rust problems when exposed to the elements.

The inner diameters 9 & 10 and circumferential geometries are all machined to a surface finish of 40 RMS or below which provides a smooth and uninterrupted surface in which the plastic wad will not load up on and the BB's will travel thru smoothly, with the outside diameters 2, 3 & 4 being machined to a surface finish of 125 RMS or below to provide aesthetics and function ability.

The geometry of all surfaces, faces, diameters and threads are to be 0.025 of an inch or below, by keeping the inner diameters 9 and 10 smooth and geometrically consistent, the ballistic patterns obtained are optimally superior.

By applying film, anodizing, hard coat anodizing, ceramic hard coating, plating, etc. on all or some of the surfaces it ensures that the aluminum choke tube will withstand being threaded in and out of the shotgun muzzle repeatedly due to it being harder and more durable than the actual hardened steel shotgun barrel that it is being screwed into or attached to.

The above mentioned coatings, when applied to the aluminum choke tube, the aluminum becomes harder than any hardened steel or stainless steel or titanium choke tube on the market today with the benefit of ⅓ the weight of steel or stainless steel.

The present Invention, thanks to its Aluminum properties is impervious to the elements as far as rust goes, and with the coatings, it becomes far more corrosion resistant, weather resistant and durable than stainless steel.

As shown in FIG. 1, a number of grooves, undercuts and/or geometric shapes are positioned to permit the user to tighten or loosen the choke tube with their hand in all weather conditions such as wet, hot, cold or adverse.

As shown in FIG. 1, there are slots, notches or grooves in the muzzle end on the face or around the muzzle area to accept a tool, such as a choke tube wrench or a spanner type wrench, to tighten or loosen if more than hand pressure is needed or wanted.

A laser etched, laser engraved or engraved identification as to what choke constriction a specific choke tube is will be easily readable and legible for the user to enjoy, this marking will be strategically placed on the outside of the choke tube so it can be seen when it is installed into the muzzle of the shotgun or out of the shotgun on its own.

At the muzzle end of the choke tube, the face of exit where the shot charge and wad exit the muzzle 8, there will be a very tight geometric tolerance held to assure proper and even exiting for repeated and utmost accuracy.

The extended portion of the Aluminum choke tube is made in a way as to accent the elegance and beauty of the users shotgun.

What I claim is:

1. A shotgun choke tube comprising:

a tube comprising a body clearance portion, a threaded portion adjacent the body clearance portion, a body portion adjacent the threaded portion, and an extended head portion adjacent the body portion, wherein an outer diameter of the extended head portion is greater than an outer diameter of the body portion, and the outer diameter of the body portion is greater then an outer diameter of the threaded portion, wherein the outer diameter of the head portion is constant along the entire length of the head portion, wherein a straight choke portion of the extended head portion, which is adjacent an end of the tube, has a constant inner diameter, wherein the tube comprises a constantly tapered inner diameter extending from a tapered portion of the extended head portion, which is adjacent the straight choke portion, to a gas seal of the body clearance portion, and wherein the tube is a single piece of aluminum.

2. The shotgun choke tube of claim 1, wherein the outer diameter of the threaded portion is greater than an outer diameter of the body clearance portion.

3. The shotgun choke tube of claim 1, wherein the extended head portion further comprises a shoulder adjacent to the body portion.

4. The shotgun choke tube of claim 1, wherein an outer surface of the extended head portion, an outer surface of the body portion, and an outer surface of the body clearance portion have a surface finish of 125 RMS or less.

5. The shotgun choke tube of claim 1, wherein an inner surface of the tube has a surface finish of 2 RMS to 125 RMS.

6. The shotgun choke tube of claim 1, wherein an inner surface of the tube has a surface finish of 40 RMS or less.

7. The shotgun choke tube of claim 1, further comprising a coating on the tube.

8. The shotgun choke tube of claim 7, wherein the coating is on all surfaces of the tube.

9. The shotgun choke tube of claim 7, wherein the coating has a hardness of 50 Rockwell to 90 Rockwell.

10. The shotgun choke tube of claim 7, wherein the coating comprises an anodized coating, a hard coat anodize coating, a ceramic anodize coating, a ceramic hard coating, a polymer diamond composite integration, or an electroless plating.

11. The shotgun choke tube of claim 1, wherein the aluminum comprises at least one of 2024-T4 aluminum, 6061-T6 aluminum, or 7075-T7 aluminum.

* * * * *